US011191396B2

(12) United States Patent
Watne et al.

(10) Patent No.: US 11,191,396 B2
(45) Date of Patent: Dec. 7, 2021

(54) HAIR REMOVAL DEVICE

(71) Applicants: Patricia Watne, Orland Park, IL (US); Andrew Watne, Orland Park, IL (US)

(72) Inventors: Patricia Watne, Orland Park, IL (US); Andrew Watne, Orland Park, IL (US)

( * ) Notice: Subject to any disclaimer, the term of this patent is extended or adjusted under 35 U.S.C. 154(b) by 0 days.

(21) Appl. No.: 16/780,222

(22) Filed: Feb. 3, 2020

(65) Prior Publication Data

US 2020/0170397 A1 Jun. 4, 2020

Related U.S. Application Data

(63) Continuation-in-part of application No. 15/952,771, filed on Apr. 13, 2018, now Pat. No. 10,765,198.

(51) Int. Cl.

| | |
|---|---|
| ***A47K 7/02*** | (2006.01) |
| ***A46B 9/02*** | (2006.01) |
| *A46B 9/06* | (2006.01) |
| *B08B 1/00* | (2006.01) |

(52) U.S. Cl.

CPC ..... *A47K 7/024* (2013.01); *A46B 9/025* (2013.01); *A46B 9/028* (2013.01); *A47K 7/02* (2013.01); *A46B 9/06* (2013.01); *A46B 2200/1006* (2013.01); *A46B 2200/30* (2013.01); *A47K 2201/02* (2013.01); *B08B 1/002* (2013.01)

(58) Field of Classification Search

CPC . A46B 9/005; A46B 9/028; A46B 2200/1006; A46B 2200/102; A46B 1/00; A47K 7/02; A47K 7/024; A47K 2201/02; A46D 1/0292; A46D 1/0238

USPC ..... D4/136

See application file for complete search history.

(56) References Cited

U.S. PATENT DOCUMENTS

| | | | | |
|---|---|---|---|---|
| 4,988,146 | A * | 1/1991 | Weihrauch | A46D 3/045 300/21 |
| 5,228,165 | A * | 7/1993 | Westberry | A47K 7/024 15/160 |
| 5,779,653 | A * | 7/1998 | Thompson | A47K 7/024 601/134 |
| 7,407,142 | B1 | 8/2008 | Lopez | |
| D709,245 | S * | 7/2014 | Zenthoefer | D28/63 |
| D762,923 | S * | 8/2016 | Combest | D28/63 |
| 9,549,611 | B1 | 1/2017 | Bocangera | |
| 2016/0309886 | A1 | 10/2016 | Oldham | |

* cited by examiner

*Primary Examiner* — Laura C Guidotti

(74) *Attorney, Agent, or Firm* — James D Palmatier; Applied Patent Services, PC

(57) ABSTRACT

The Hair Removal Device may be a wall mounted assembly of a base attached to a wall. The base having a plurality of holes extending from a top to a bottom. A cluster of tentacles mounted on a bristle ball body. The body having a suction cup on a stem, the suction cup spaced from the tentacles. The base disposed between the suction cup and the tentacles. The bristle ball having a plurality of tentacles extending radially from the bristle ball. The bristles formed of a flexible, resilient material. The each one of the plurality of holes filled with a stem holding the suction cup on the base and the tentacles spaced from the base.

12 Claims, 4 Drawing Sheets

FIG. 13
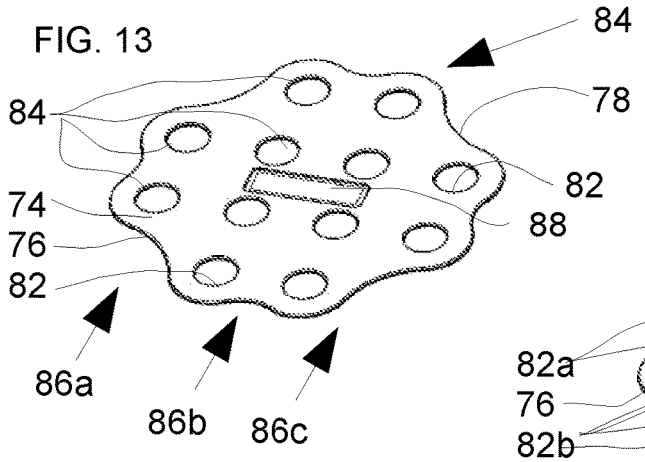
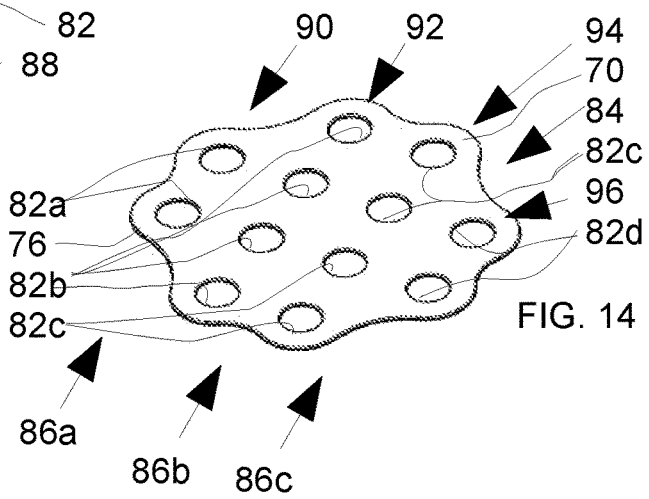
FIG. 14
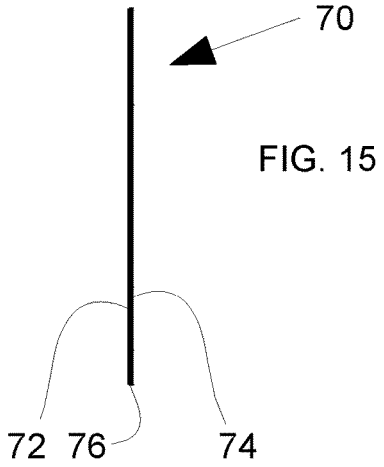
FIG. 15
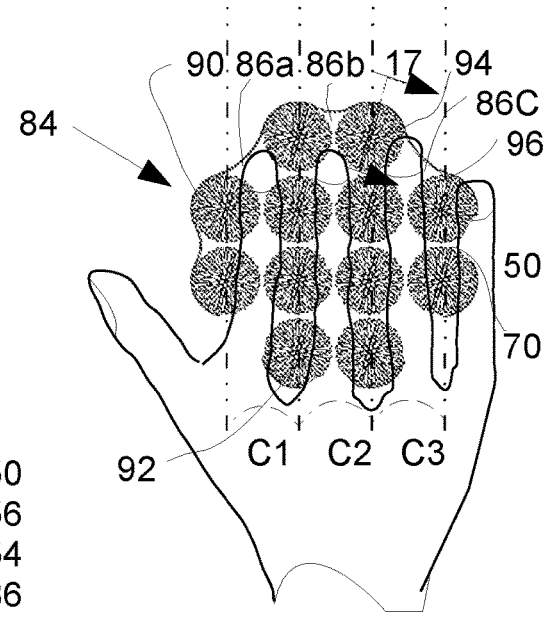
FIG. 16
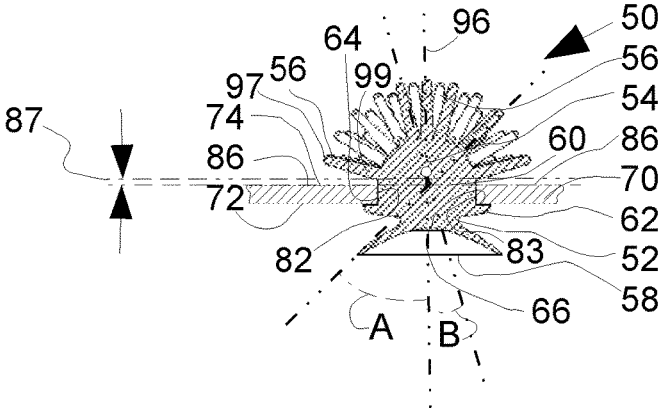
FIG. 17

HAIR REMOVAL DEVICE

FIELD OF THE INVENTION

The Hair Removal Device relates to shower wall items used in personal bathing.

BACKGROUND OF THE INVENTION

Showers in common use consist essentially of a relatively smaller enclosure or stall which has a shower arm and head protruding from a wall, and which is closeable by a shower curtain or by a sliding or swinging door. Typically, an enclosure includes three walls (in the case of a lateral wall enclosure) or two walls (in the case of a corner enclosure) to define a showering/bathing area. The enclosure walls can be tiled or made of a water resistant material, such as glass or plastic. Soap and hair debris may collect on a bather while using the shower. Transferring the debris to the wall or door is messy and unsightly. An opening to the enclosure is generally closed off by a door or curtain, which prevents flipping the debris out of the shower.

Of special concern is hair from the bather's head may become entangled on fingers and hands. It is usually most desirable to prevent the hair from going down the drain. Prior art devices try to catch the hair at the drain opening with a screen or filter. U.S. Pat. No. 9,549,611 B1 to Bocanegra provides a hair screen (62) attached to the wall to allow runoff from the hands to be screened on the way to the drain. The problem still remains for the hair twisted about the users fingers that must be removed.

Accordingly, there is a need for a device such as shower caddy that has a means to remove hair from a users hands and retain the hair for later disposal. Also, the new shower hair removal device should be easily manufactured and assembled. In addition, there is a need for a shower caddy that is portable or can be relocated and may accommodate hands of different sizes.

BRIEF DESCRIPTION OF THE PRESENT INVENTION

The Hair Removal Device comprises a plurality of hair grabbing clusters of spines or tentacles interconnected in an array to accommodate the user dragging each of their hair laden fingers through a defined finger row. The Hair Removal Device may have a base removably mounted on a shower wall having a plurality of bristle balls attached on the top in a configuration comprising a first, second and third finger rows on the top. Each of the bristle balls having a plurality of tentacles attached radially. Each of the tentacles having a first end and a second end, each first end on the respective bristle ball, each second end disposed along a radius to the bristle ball. Each tentacle spaced from the interconnect. The interconnect may be a plate or a frame or other manner of interconnection. The tentacles or spines may be formed from a latex or rubber type material having a flexibility while resiliently holding their manufactured shape. The bristle balls are mounted in clusters to define finger rows of bristle balls to engage user fingers to help with hair removal from the fingers. The tentacles may be oriented at a variety of different radial angles to the bristle ball body to engage a users fingers at a predetermined angle to urge loose hair off of the hand.

The bottom side of the body may be adapted to attach to a smooth surface such as a tile or glass wall with suction cups. The suction cups operationally attached to the body with the suction cup portion extending from the bristle plate bottom. The suction cup attachment to a wall may hold the Hair Removal Device in a position and at a predetermined height and orientation to be convenient for the user.

The hair removal device may be mounted on a shower wall in a shower. The user, having hair on his hands may rub the hand over the Hair Removal Device placing the index finger in the index row, the middle finger in the middle row and the ring finger in the ring row. Spines projecting upward from the base and extending into the rows rub on the finger thus engaging hair follicles on the user's hand and retaining the follicles as the user removes his hand. The Hair Removal Device may be easily cleaned of the follicles for proper disposal.

The hair removal device may comprise a plurality of separately made bristles, and bristle plate. Each of the plurality of bristles comprising a suction cup base and a body. The bristle plate having a plurality of bristle holes formed from front to back. Each one of the plurality of bristles adapted to fit in a bristle hole thereby arranging the plurality of bristles into a predetermined pattern defining a plurality of finger rows. Each of the finger rows adapted to receive a user finger having tentacles extending into the finger row. The spines engage the user finger when used. The suction cup on each of the plurality of bristles adapted to extend from the back of the bristle plate to attach to a wall to hold the bristles in spaced relation to the wall. The body having a plate flange adjacent to the base and in spaced relation to the spines. The wall plate comprising a bristle plate. A plurality of bristle holes in the bristle plate. The plurality of bristle holes disposed in a predefined hand shaped pattern. Each of the plurality of bristles in one of the plurality of bristle holes. The bristle plate between the plate flange and the spines. The plurality of bristles disposed in a predefined hand shaped pattern.

It should be understood, the tentacles on each bristle ball body may be divided into at least a first portion of the plurality of tentacles extending radially from the respective bristle ball body at a first predefined angle to an axis of the stem. A second portion of the plurality of tentacles on each bristle ball body may extend radially from the respective bristle ball at a second angle to an axis of the stem, the first angle different from the second angle. Tentacles may extend at a variety of angles to the axis of the stem. The angles being between 0 and 90 degrees while spacing the tentacles from the bristle plate.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE SEVERAL VIEWS OF THE DRAWING

FIG. 13 is a top perspective view of a bristle plate.

FIG. 14 is a bottom perspective view of the bristle plate of FIG. 13.

FIG. 15 is a side elevation view of the bristle plate of FIG. 13.

FIG. 16 is a top plan view of an alternate embodiment of the hair removal device having a plurality of removable bristle clusters attached to a bristle plate.

FIG. 17 is a section view of a bristle cluster attached to a bristle plate taken at approximately 17-17 of FIG. 16.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting. It should be appreciated that the invention can be used for any suitable.

Figure 1:
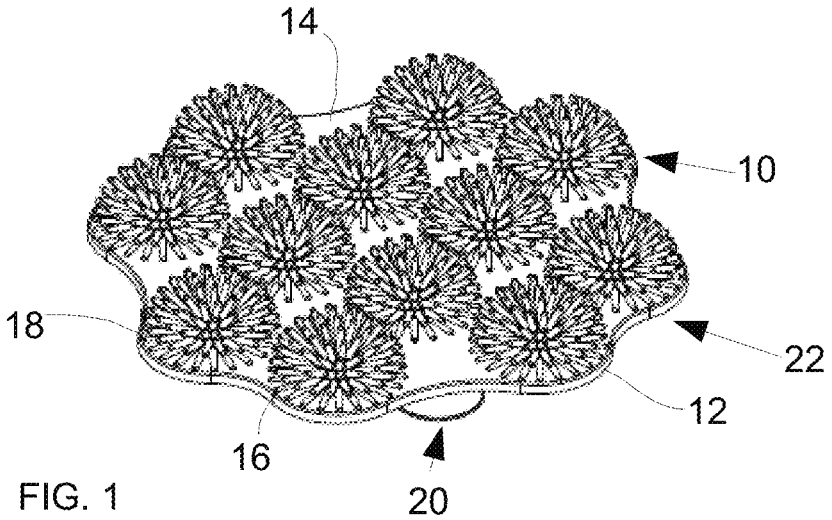
FIG. 1 is a top perspective view of the Hair Removal Device.

Referring to FIG. 1, the hair removal device 10 may comprise a generally flat bristle plate 12 having a bristle plate top 14 and clusters 16 of tentacles 18. A wall attachment 20 may be on the bristle plate 12 opposite the clusters 16. The clusters 16 may be arranged in rows or columns or in a grid type arrangement 22 on the body top 14.

Figure 2:
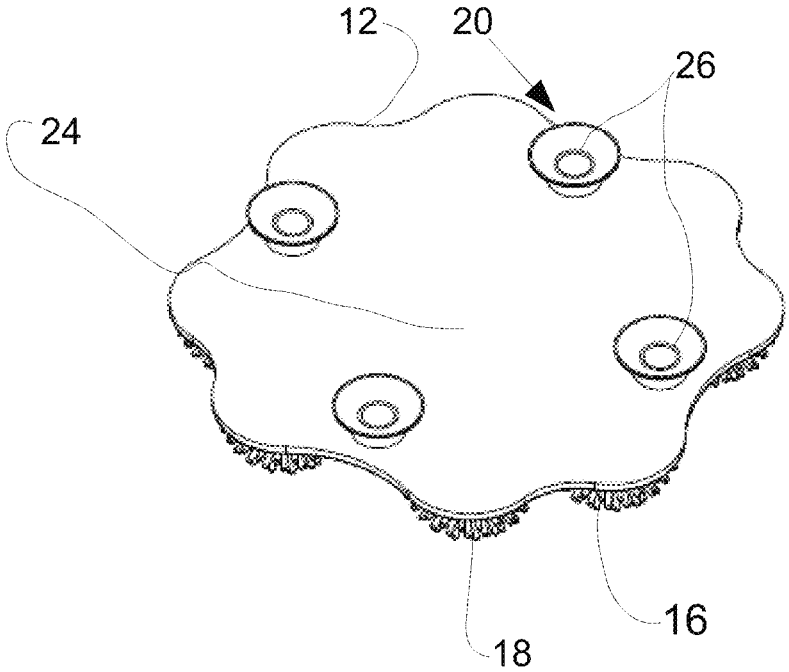
FIG. 2 is a bottom perspective view thereof.

Referring to FIG. 2, the bristle plate 12 may further comprise a bristle plate bottom 24 opposite bristle plate top 14. The wall attachment 20 on the bristle plate bottom 24 may comprise a suction cup operationally attached adjacent to the bristle plate bottom 24.

Figure 3:
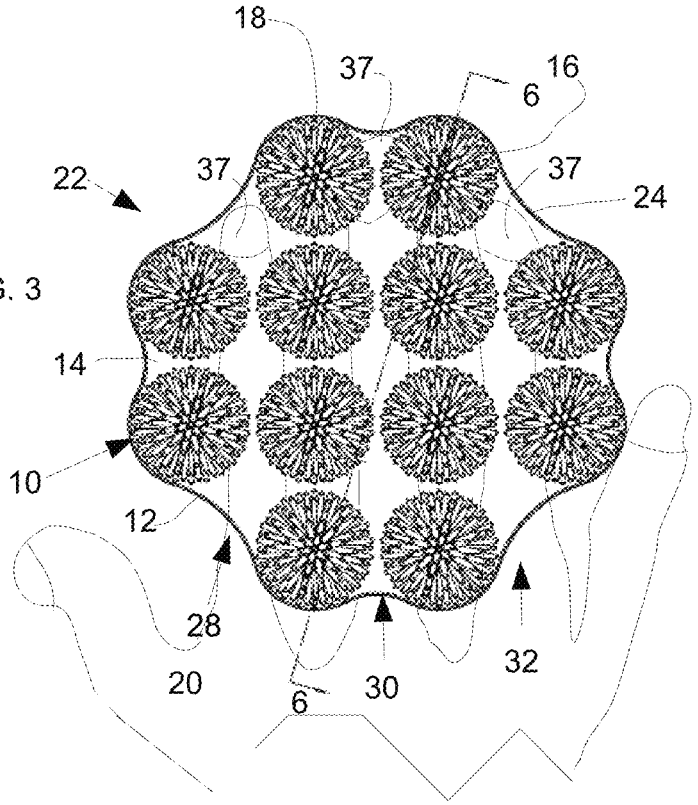
FIG. 3 is a top plan view thereof.

Referring to FIG. 3, the bristle clusters 16 may be configured on the bristle plate top 14 in a predetermined pattern to create an index finger row 28, a middle finger row 30 and a ring finger row 32. Each of the finger rows 28, 30, 32 may have a spacing of one centimeter between adjacent tentacles 18 extending into the respective finger rows 28, 30, 32. The bristle clusters 16 may be arranged in 4 rows defining three finger rows 28, 30, 32. A space 34 may be disposed between clusters 16 to accommodate cleaning and create the finger rows 28, 30, 32. The clusters 16 may be disposed about the base perimeter 34. A hand 35 having fingers 37 is placed on the Hair removal device 10 having one finger 37 in each respective finger row 28, 30, 32.

Figure 4:
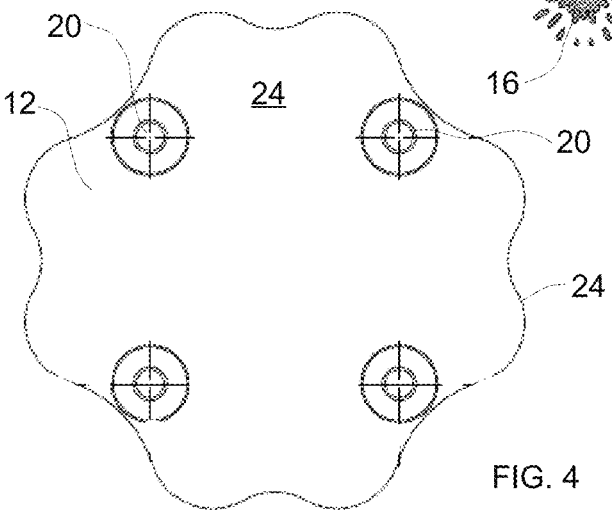
FIG. 4 is a bottom plan view thereof.

Referring to FIG. 4, the suction cups 26 may be arranged in a pattern to hold the hair removal device 10 in a predetermined orientation. Suction cups 26 may be disposed opposite clusters 16 (FIG. 1).

Figure 5:
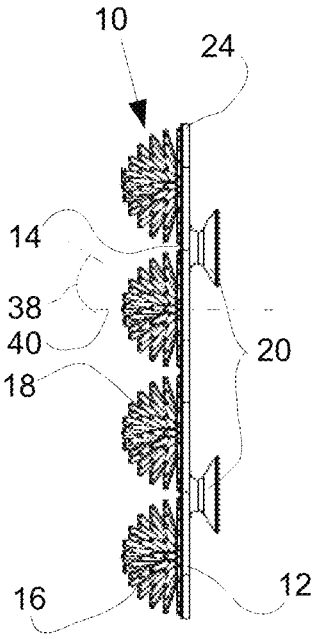
FIG. 5 is a side elevation view thereof.

Referring to FIG. 5, clusters 16 and suction cups 26 may be integrally formed on the base 12. Each cluster 16 may have a cluster base 36 having tentacles 18 attached thereto. Each tentacle 18 projects from the body 14 at a predetermined angle 38 to the cluster axis 40. The cluster base 36 attached to the body 14 on the body top 16. Each tentacle 18 having a first end 42 on the cluster base 36 and a second end 44 spaced from the cluster base 36.

Figure 6:
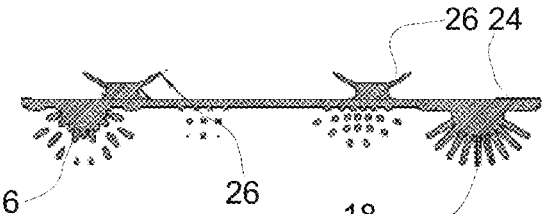
FIG. 6 is a section view thereof taken at approximately 6-6 of FIG. 3.

Referring to FIG. 6, the hair removal device 10 may have air space 46 between tentacles 18. The tentacles 18 are formed from a flexible material such as latex, rubber or similar resilient material. Tentacle hair engagement end 44 may be suspended in or adjacent to a row 28, 30, 32 on the body top 16. Clusters 16 may be integrally molded with the body 12. Suction cups 26 may be mounted opposite clusters 16 on body 12. Suction cups 26 may further comprise a cup base 48 on the body bottom and a cup 50 on the cup base 48. The cup base 48 is attached to the body 12. The cup 50 is spaced from the body 12. Suction cups 26 may be integrally molded with the base 12 and clusters 16.

Figure 7:
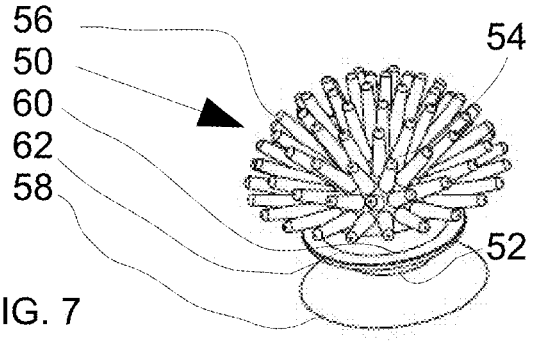
FIG. 7 is a top perspective view of a bristle cluster.
Figure 8:
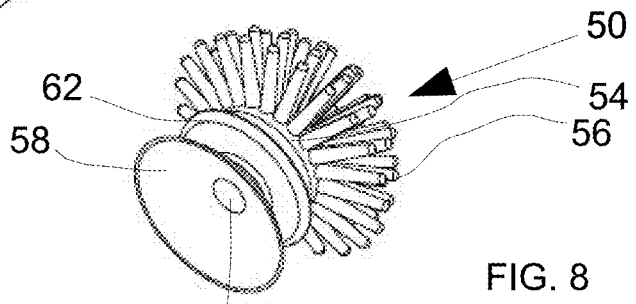
FIG. 8 is a bottom perspective view of the bristle cluster of FIG. 7.
Figure 9:
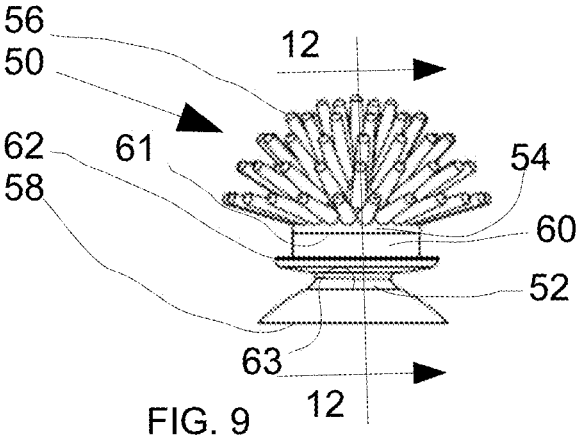
FIG. 9 is a side elevation view of the bristle cluster of FIG. 7.

Referring to FIG. 7, each bristle cluster 50 may comprise a separate bristle ball body 54 and a bristle ball base 52. Each bristle ball body 54 comprising a plurality of tentacles 56. The base 52 may comprise the stem 60, a body flange 62 and a suction cup 58. The stem 60 may extend between the base 52 and the tentacles 56. The body flange 62 is spaced from the bristle ball body 54.

Figure 12:
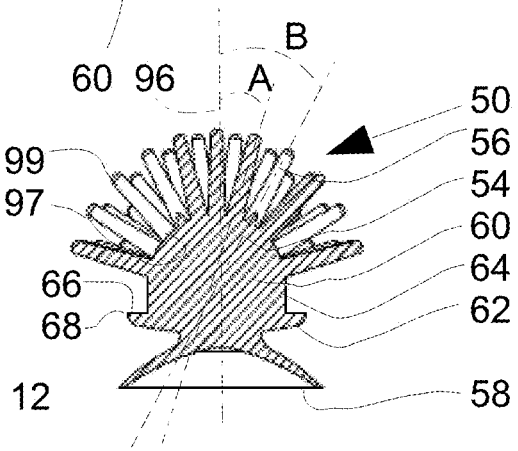
FIG. 12 is a section view taken at approximately 12-12 of FIG. 9.
Figure 10:
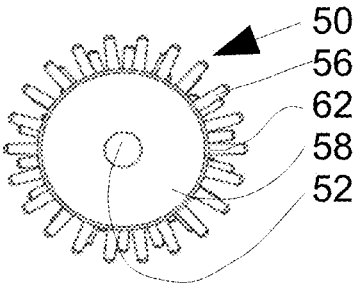
FIG. 10 is a bottom plan view of the bristle cluster of FIG. 7.
Figure 11:
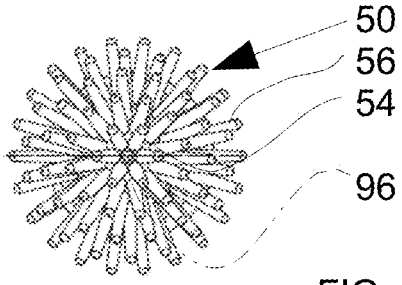
FIG. 11 is a top plan view of the bristle cluster of FIG. 7.

Referring to FIG. 12, a first portion of the plurality of tentacles 56 on each bristle ball body 54 extending radially from the respective bristle ball body 54 at a predefined angle A to an axis 96 of the stem 60. A second portion of the plurality of tentacles 56 on each bristle ball body 54 extending radially from the respective bristle ball body 54 at a second angle B to an axis 96 of the stem 60. It should be understood that a plurality of portions of the plurality of tentacles 56 may each extend radially from the respective bristle ball body 54 at a plurality of angles A, B. Angles A, B are different from each other. Angles A, B may be between 0 and 90 degrees. The stem 60 may comprise a first stem end 61 and a second stem end 63. The first stem end 61 on the respective bristle ball body 54. The second stem end 63 on the respective suction cup 58.

Continuing to refer to FIGS. 7-12, body flange 62 may be disposed on the stem 60 in spaced relation to the bristle ball body 54 and the tentacles 56. The body flange 62 may further comprise a body side 66 and a perimeter 68. A body channel 64 surrounding the stem 60 between the body flange 62 and the bristle ball body 54. The body channel 64 may be a base bearing surface on the stem or may comprise an indented groove in the stem adapted to receive the inner surface 83. The body flange 62 may be adjacent to the body channel 62. The body flange 62 may circumvent stem 60 between bristle ball body 54 and base 52. Each tentacle 56 may comprise a first end 97 and a second end 99. The first tentacle end 97 on the body ball 55. The second tentacle end 99 spaced from the body ball 55 by the tentacle 56 extending at a predetermined angle A, B from the bristle ball axis 96. The first, second, third and the first tentacle end 97 is spaced from the base top by spacing 87. The fourth bristle cluster may be disposed on the bristle plate having the first cluster spaced from the second cluster thereby defining a first finger row, the third cluster spaced from the second cluster thereby defining a second finger row between the second and third clusters, the fourth cluster disposed on the bristle ball plate in spaced relation to the third cluster defining a third finger row.

Referring to FIGS. 13-15, bristle plate 70 may comprise a bristle plate bottom 72, a bristle plate top 74 and a bristle plate edge 76. Bristle plate edge 76 defining a perimeter 78. Perimeter 78 may be configured as a shape 80 selected from such shapes as a circle, rectangle, animal or hand or freeform shapes 80. The bristle plate 70 may comprise a plurality of bristle holes 82. Each one of the plurality of bristle holes 82 extends from the bristle plate top 74 to the bristle plate bottom 72. Each one of the plurality of bristle holes 82 may be disposed in a predetermined hand configuration 84. The predetermined hand configuration 84 may comprise finger channels 86 extending across the perimeter 78. A recess 88 may be formed in the bristle plate top 74 or bristle plate bottom 72. The recess 88 may be used for labeling, fastening or branding space for logos or trademark information.

Referring to FIG. 16, the hand configuration 84 may comprise a first finger row 90, a second finger row 92, a third finger row 94 and a fourth finger row 96. The first finger row 90 disposed in spaced relation to each other adjacent the perimeter 78, the second finger row 92 may be disposed in a generally straight row 92 spaced from the first finger row 90. The second finger row 92 may be aligned in a predetermined angular orientation C to the first finger row 90. The first finger channel 86*a* disposed between the first finger row 90 and the second finger row 92. The third finger row 94 may be disposed in a generally straight row 94 aligned in a predetermined angular orientation C to the second finger row 92. The second finger channel 86*b* may be disposed between the second finger row 92 and the third finger row 94. The predetermined angular orientation C may be generally parallel or at an acute angle and may be different between adjacent rows 90, 92, 94, 96.

Referring to FIG. 17, the bristle 50 may be attached to the bristle plate 70 by inserting one of the plurality of bristles 50 in one of the plurality of bristle holes 82. The bristle cluster 50 is adapted to elastically deform while passing through the bristle hole 82. The bristle cluster 50 is disposed on the bristle plate 70 having the body top 74 adjacent the bristle ball 54 and the body flange 62 on the bristle plate bottom 72. The flange body side 66 bears against the bristle plate bottom 72. The bristle hole 82 comprises an inner surface 83 on the bristle plate 70, surrounding the bristle hole 82. The inner surface 83 may be on the body channel 64.

Continuing to refer to FIG. 17, the plurality of bristles 50 may be configured as a first row 90, a second row 92 and a third row 94. The bristle ball 54 may have an axis 96. The tentacles 56 are spaced from the base top 86 by spacing 87. The stem 60, bristle ball 54 and base 52 may be disposed along axis 96. The tentacles 56 are disposed at a plurality of angles A, B to axis 96. Angles A, B are between 0 and 90 degrees. Suction cup 58 on stem second end 63. Suction cup 58 may be disposed adjacent bristle plate bottom 72. Body flange 62 may be disposed between suction cup 58 and bristle plate bottom 72. Bristle ball 54 may be disposed in spaced relation from bristle plate 70. Each of the first tentacle ends 97 spaced from the bristle plate top 74. Each of the second tentacle ends 99 spaced from the bristle plate top 74.

In use, the hair removal device 10 may be mounted to a wall or shelf and positioned to receive a user's fingers thereon. The tentacles are disposed in a finger channel configuration. The tentacles may be removed for cleaning and replacement. The suction cups may be disposed on the base or the bristle body.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

We claim:

1. A hair removal device comprising:

a bristle plate, the bristle plate comprising a bristle plate top, a bristle plate bottom and a plurality of bristle holes, each one of the plurality of bristle holes extending from the bristle plate top to the bristle plate bottom;

a plurality of suction cups;

a first bristle cluster and a second bristle cluster, each bristle cluster comprising a bristle ball body, a stem and a plurality of tentacles, each stem comprising a body flange, a first stem end and a second stem end, each first stem end on the respective bristle ball body, one of the plurality of suction cups on the second stem end, the stem on the first bristle cluster in a first one of the plurality of bristle holes, the stem on the second bristle cluster in a second one of the plurality of bristle holes, the tentacles in spaced relation to the bristle plate top, the base plate disposed between the respective first and second ends, the body flange on the stem, the body flange spaced from the bristle ball body, the body flange spaced from the suction cup, the body flange bearing on the bristle plate bottom whereby each bristle cluster with suction cup attached is on the body plate; and a first finger row disposed on the bristle plate top, the first finger row between the first bristle ball body and the second bristle ball body.

2. The hair removal device of claim 1, wherein the stem on each of the first and second bristle balls further comprises a body channel, the bristle plate on the body channel.

3. The hair removal device of claim 2, wherein the bristle ball body on each of the first and second bristle clusters bears against the bristle plate top whereby the bristle plate is between the body flange and the bristle ball body of each respective bristle cluster.

4. The hair removal device of claim 2, wherein a first portion of the plurality of tentacles on each bristle ball body extends radially from the respective bristle ball body at a first predefined angle to an axis of the stem, a second portion of the plurality of tentacles on each bristle ball body extends radially from the respective bristle ball at a second angle to the axis of the stem, the first angle different from the second angle.

5. The hair removal device of claim 1, further comprising a third and a fourth bristle cluster, the third cluster spaced from the second cluster thereby defining a second finger row between the second and third clusters, the fourth cluster disposed on the bristle plate in spaced relation to the third cluster defining a third finger row therebetween.

6. The hair removal device of claim 5 wherein each of the plurality of tentacles further comprises a first end and a second end, the first end on the respective bristle ball body, the second end spaced from the respective bristle ball body, each of the tentacle first and second ends spaced from the bristle plate.

7. The hair removal device of claim 1, further comprising additional clusters disposed on the bristle plate, each one of the additional clusters disposed in one of a plurality of finger groups, each finger group spaced from each other finger group, a finger row between each finger group, the finger rows spaced from each other.

8. A hair removal device comprising a flat bristle plate and a plurality of bristle clusters, the flat bristle plate comprising a plurality of bristle holes, each of the plurality of bristle holes comprising an inner surface on the bristle plate body, the bristle plate comprising a body top, a body bottom and a perimeter, each one of the plurality of bristle clusters comprising a bristle ball body and a stem, each bristle ball body comprising a plurality of tentacles, each stem comprising a first end a body channel and a second end, each first end on the respective bristle ball body, each second end spaced from the respective bristle ball body, each body channel disposed between the first end and the second end each stem in a respective one of the plurality of bristle holes having the inner surface on the body channel whereby the bristle plate is disposed between the first end and the second end, a suction cup on the second end, the tentacles extending radially from the bristle ball body, the tentacles disposed in spaced relation to the bristle plate, the tentacles disposed at a variety of angles to an axis of the stem, each one of the plurality of bristle cluster bodies spaced from adjacent other ones of the plurality of bristle cluster bodies, the bristle clusters disposed in an arrangement to form a plurality of finger channels on the body top, each one of the plurality of finger channels spaced from each other one of the plurality of finger channels, one of the plurality of bristle clusters disposed between each one of the plurality of finger channels.

9. The hair removal device of claim 8, wherein each finger channel is disposed between two generally parallel rows of bristle cluster bodies, each of the plurality of tentacles comprising a first end on the respective bristle cluster body and a second end spaced from the bristle cluster body.

10. The hair removal device of claim 9, further comprising some of second ends of the plurality of tentacles are disposed between the two generally parallel rows of bristle cluster bodies.

11. The hair removal device of claim 8, further comprising a body flange on the stem, the body flange bearing on the body bottom.

12. A hair removal device comprising a flat bristle plate and a plurality of bristle clusters, the flat bristle plate comprising a body top, a body bottom, a perimeter and plurality of bristle holes, each one of the plurality of bristle clusters comprising a respective bristle ball body a suction cup and a stem, each bristle ball body comprising a plurality of tentacles, each stem comprising a first end and a second end, each first end on the bristle ball body, each second end on the suction cup, each stem disposed in a respective bristle hole whereby the bristle ball body is adjacent the body top and the suction cup is adjacent the body bottom, the tentacles extending radially from the bristle ball body, the tentacles disposed in spaced relation to the bristle plate, the tentacles disposed at a variety of angles to an axis of the stem, each one of the plurality of bristle clusters spaced from adjacent other ones of the plurality of bristle clusters defining a plurality of finger channels on the body top, each finger channel disposed between two generally parallel rows of ones of the plurality of bristle ball bodies, each one of the plurality of finger channels spaced from each other one of the plurality of finger channels, one of the plurality of bristle clusters disposed between each two adjacent ones of the plurality of finger channels, the stem further comprising a body channel, each of the plurality of bristle holes comprising an inner surface on the bristle plate body, the inner surface on the body channel.

* * * * *